US005585590A

United States Patent [19]

Ducolon

[11] Patent Number: 5,585,590

[45] Date of Patent: Dec. 17, 1996

[54] RECOIL COUNTER-VECTORING GUN

[76] Inventor: Fredric D. Ducolon, 5303 Pacific Hwy. E., #172, Fife, Wash. 98424

[21] Appl. No.: 437,095

[22] Filed: May 5, 1995

[51] Int. Cl.[6] ..... F41A 25/00

[52] U.S. Cl. ..... 89/42.01; 89/162; 42/1.06

[58] Field of Search ..... 42/1.06, 69.01, 42/69.02; 89/42.01, 162, 165, 1.701, 1.7, 136, 177, 44.01

[56] References Cited

U.S. PATENT DOCUMENTS

| | | | |
|---|---|---|---|
| 39,449 | 8/1863 | Long | 89/44.01 |
| 789,806 | 5/1905 | Haussner . | |
| 886,611 | 8/1907 | Kanonenberg | 89/44.01 |
| 2,564,360 | 8/1951 | Hammar et al. | 89/37 |
| 5,014,595 | 5/1991 | Ducolon | 89/44.01 |

FOREIGN PATENT DOCUMENTS

| | | |
|---|---|---|
| 302546 | 4/1917 | Germany . |

*Primary Examiner*—Michael J. Carone
*Assistant Examiner*—Christopher K. Montgomery
*Attorney, Agent, or Firm*—Glenn D. Bellamy

[57] ABSTRACT

A recoil counter-vectoring gun (10) is shown having a gun barrel assembly (14, 16, 20) slidably mounted on a frame (12). A counterweight assembly (26) is also slidably mounted on the frame (12) and is shifted forwardly by rearward recoil of the gun barrel assembly (14, 16, 20) by means of cables (38, 40) and pulleys (28A, 28B and 36A, 36B) to move forward substantially twice the distance that the gun barrel assembly recoils rearwardly. The counterweight assembly (26) preferably includes at least one throwweight (58) which is shifted from a rearward to a forward position along a declining path as the counterweight assembly reaches its forwardmost position on the frame (12). The counterweight assembly (26) is automatically returned by springs (52) and the throwweights (58) are reset and cocked by return of the counterweight assembly (26).

14 Claims, 5 Drawing Sheets

RECOIL COUNTER-VECTORING GUN

TECHNICAL FIELD

This application relates to a gun having a mechanism for redirecting or minimizing recoil by movement of one or more counterweights in a direction opposite to the recoil and a distance approximately twice that of recoil associated with a gun barrel assembly. Specifically, this invention also relates to the use of one or more throwweights on a counterweight assembly which are rapidly shifted forwardly and downwardly at a predetermined point along the line of travel of the counterweight assembly so as to maximize the recoil counter-vectoring effect.

BACKGROUND OF THE INVENTION

A basic law of physics is that every action has an equal and opposite reaction. The reaction, or recoil, of firing a large caliber gun can be quite significant and undesirable.

Mechanisms have been made which store up the energy produced by a recoiling gun part in a spring or similar shock absorber. The shock-absorbing spring may be situated to absorb the recoil directly, as shown in U.S. Pat. No. 2,564,360, or indirectly by transfer through cables and pulleys, as shown in U.S. Pat. No. 789,806.

My previous U.S. Pat. No. 5,014,595, issued May 14, 1991, relates to a recoil redirecting mechanism for a gun which utilizes a series of pulleys and cable to forwardly shift a counterweight as a gun barrel assembly is shifted rearwardly in response to recoil forces. In that mechanism, forward movement of a block assembly is approximately half the rearward travel distance of the gun barrel assembly.

SUMMARY OF THE INVENTION

The present invention provides a recoil counter-vectoring gun with a gun barrel assembly and counterweight assembly independently slidably mounted on a frame. The gun barrel assembly includes a barrel and a receiver having a bolt therein and will longitudinally reciprocate on the frame between a forward position and a rearward position. A means is provided for firing the gun when the gun barrel assembly is substantially at its forwardmost position. An adjustable recoil counter-vectoring mechanism is provided which comprises a counterweight assembly which longitudinally reciprocates on the frame between a forward position and a rearward position independent of the gun barrel assembly, a fixed pulley mounted on the frame, a traveling pulley mounted on the gun barrel assembly, and a cable means. The cable means has a first end fixed relative to the frame. It then passes over the traveling pulley, the fixed pulley, and toward a second end which is attached to the counterweight assembly. When the gun is fired, the gun barrel assembly recoils rearwardly such that rearward movement of the traveling pulley causes the cable means to pull the counterweight assembly forward on the frame a distance substantially equal to twice the recoil distance of the gun barrel assembly.

Another aspect of the present invention includes providing at least one throwweight assembly mounted on the counterweight assembly for movement between a forward and rearward position. The throwweight is shifted forwardly on the counterweight assembly at a predetermined position relative to full forward movement of the counterweight assembly. In preferred form, the movement of the throwweight is at a downward angle relative to sliding movement of the counterweight assembly and may be guided along a flexible cable having opposite ends supported by the counterweight assembly.

Other features and aspects of the present invention will become apparent upon studying the accompanying drawing, best mode for carrying out the invention and claims, all of which are incorporated herein as part of the disclosure of this invention.

BRIEF DESCRIPTION OF THE DRAWINGS

Like reference numerals are used to indicate like parts throughout the various figures of the drawing, wherein.

BEST MODE FOR CARRYING OUT THE INVENTION

Figure 1:
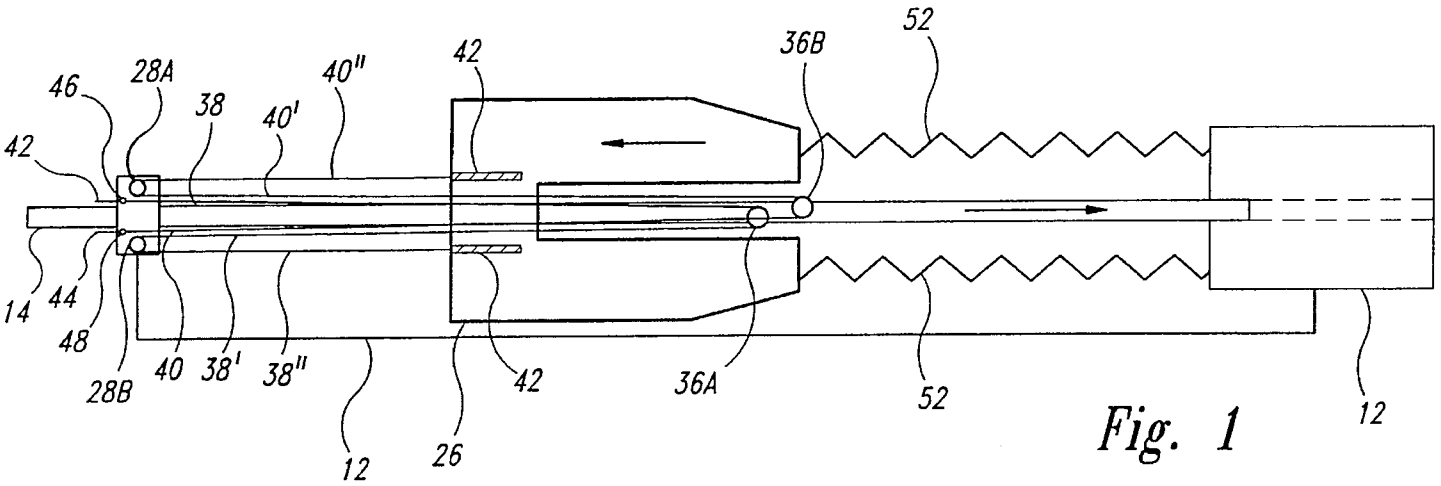
FIG. 1 is a schematic diagram illustrating forward movement of a counterweight assembly a distance approximately twice the distance in which the gun barrel assembly recoils rearwardly through a series of cables and pulleys.
Figure 3:
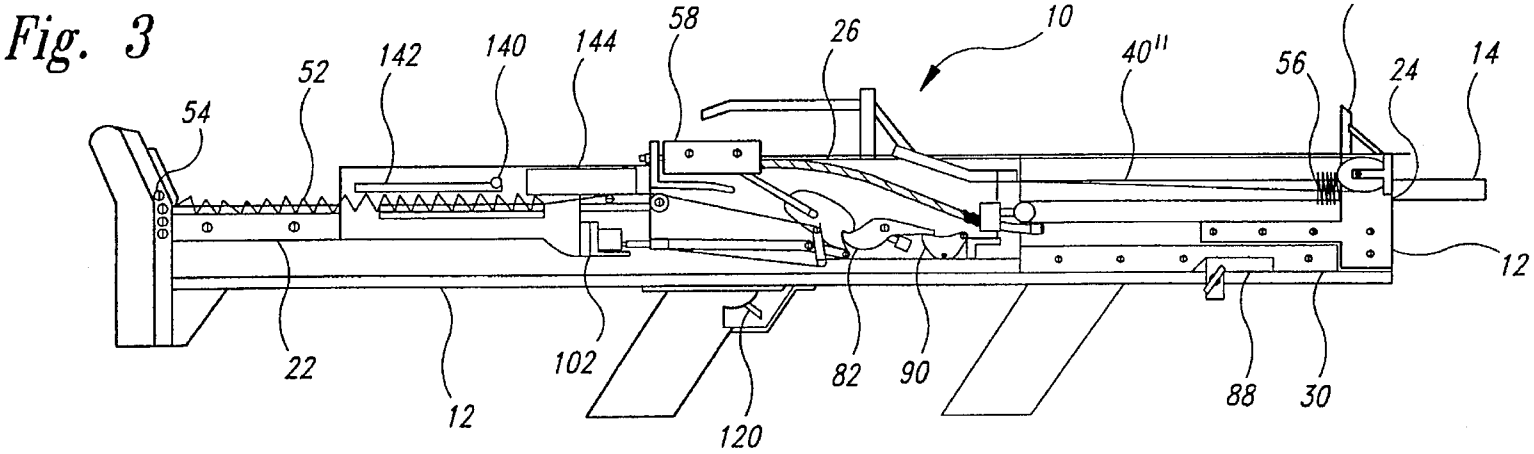
FIG. 3 is a right side plan view of a gun according to the present invention.
Figure 2:
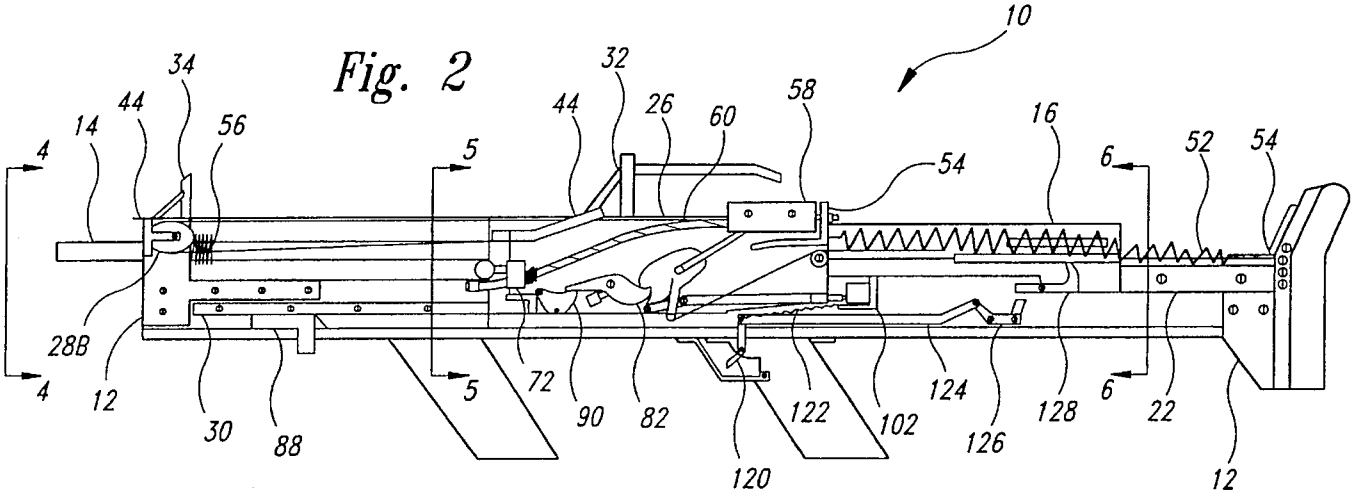
FIG. 2 is a left side plan view of a gun according to the present invention.
Figure 6:
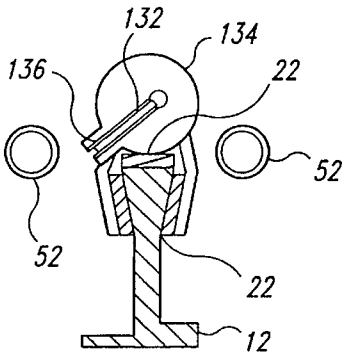
FIG. 6 is a cross-sectional view taken substantially along line 6—6 of FIG. 2.
Figure 4:
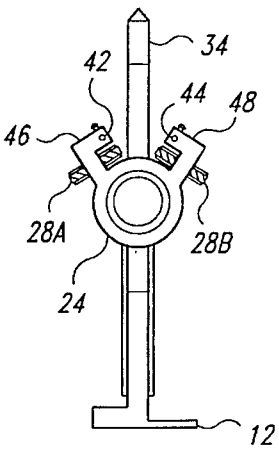
FIG. 4 is a front plan view taken substantially along line 4—4 of FIG. 2.

Referring to the several figures of the drawing, and first to FIG. 1, therein is shown a schematic diagram illustrating the counterweight recoil vectoring mechanism for a gun of the present invention. Referring to FIGS. 2 and 3, therein is shown at 10 left and right side views of a preferred embodiment of the present invention. The gun includes a frame 12 on which a gun barrel assembly is slidably mounted. The gun barrel assembly includes a barrel 14 and a receiver 16. The receiver 16 includes a shell chamber 18 and a slidable bolt 20. The gun barrel assembly is mounted to slide on bearings 22 on the frame 12 and through a guide sleeve 24 at the forward end of the frame 12. These are shown more specifically in FIGS. 4 and 6. A counterweight assembly 26 is also slidably mounted for longitudinal reciprocation on the frame 12. At least one fixed pulley, and in preferred form two fixed pulleys 28A, 28B, are mounted at the forward end of the frame 12. In preferred form, the pulleys 28A, 28B are situated obliquely on the upper side of the tubular guide 24. This is most clearly shown in FIG. 4.

Figure 5:
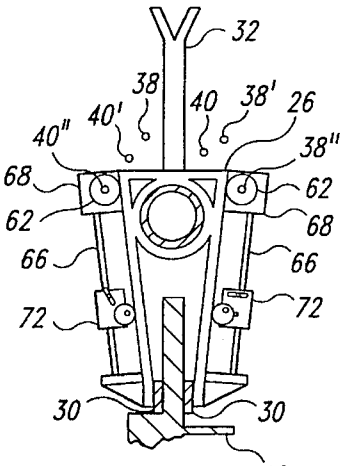
FIG. 5 is a cross-sectional view taken substantially along line 5—5 of FIG. 2.

Referring also to FIG. 5, the counterweight assembly 26 slides on bearings 30 on the frame 12 and moves freely with respect to the barrel 14. Upwardly extending from the counterweight assembly 26 is a rear sight 32. Upwardly extending from the forward tubular guide 24 is a forward sight 34.

Figure 9:
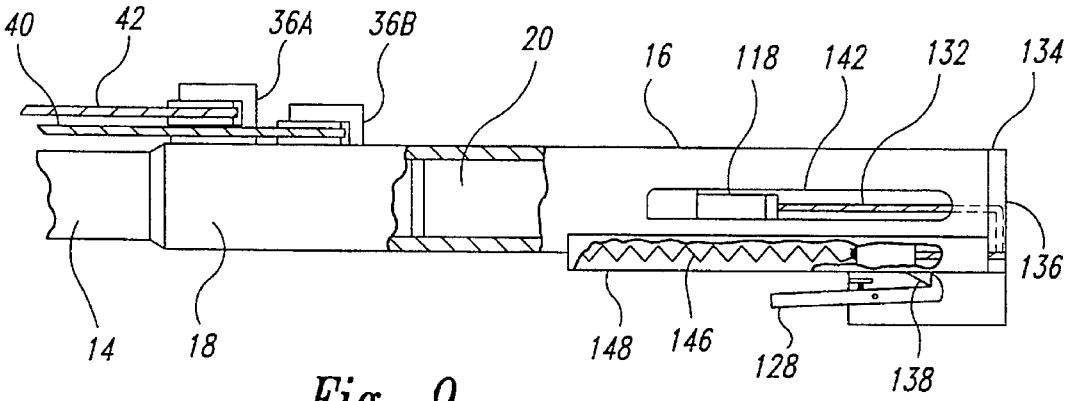
FIG. 9 is an enlarged fragmentary, partially cut-away view of the receiver and firing mechanism of the gun.
Figure 10:
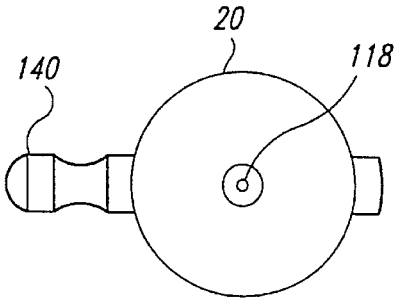
FIG. 10 is a front view of the bolt.
Figure 12:
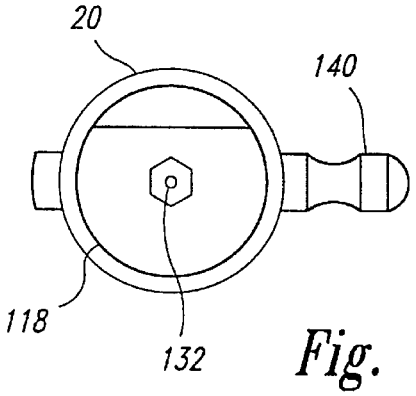
FIG. 12 is a rear view of the bolt.

Rearward of the counterweight assembly 26 at least one traveling pulley, and in preferred form a pair of traveling pulleys 36A, 36B, are mounted on the gun barrel assembly, preferably on the receiver 16, as shown in FIG. 9. A cable or cables 38, 40 interconnect the frame 12, barrel 14 and counterweight assembly 26. The cable and pulley mechanism illustrated in FIG. 1 causes the counterweight assembly 26 to move forward as the gun barrel assembly recoils rearwardly on the frame 12. The particular configuration of this invention causes the counterweight assembly 26 to move forwardly twice the distance that the gun barrel assembly moves rearwardly in the same amount of time.

Figure 7:
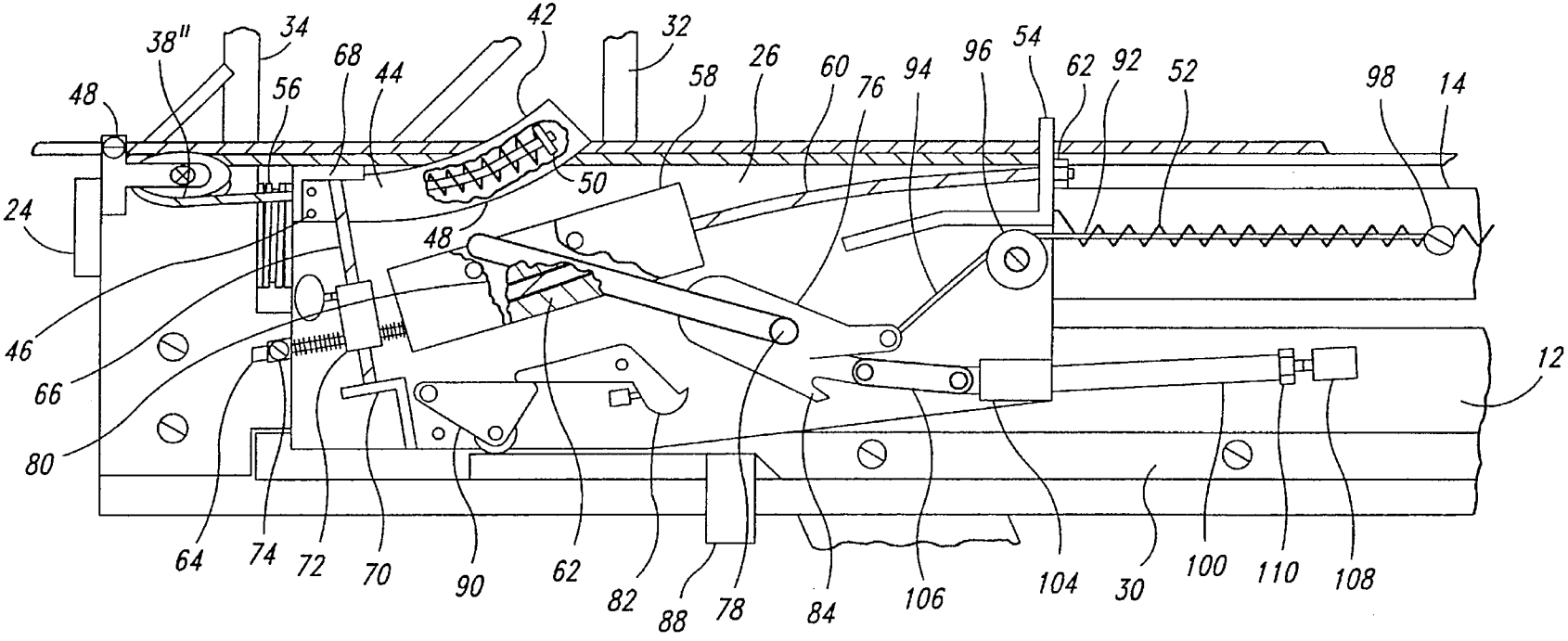
FIG. 7 is an enlarged fragmentary view of the throwweight mechanism on the counterweight assembly on the left side of the gun.

In FIGS. 1–9, it can be seen that each cable 38, 40 has a first end 42, 44 which is adjustably fixed, such as by set screw, 46, 48, to the forward guide member 24 of the frame 12. Each cable 38, 40 then extends rearwardly to traveling pulleys 36A, 36B mounted on the gun barrel assembly. These pulleys 36A, 36B are freely rotatable and act to reverse the direction of the cables 38, 40. A second segment of each cable 38', 40' then extends toward and around the fixed position pulleys 28A, 28B. These pulleys 28A, 28B are freely rotatable but fixed in space relative to the frame 12. After being reversed in direction by pulleys 28A, 28B, yet another section of the cable 38", 40" extends rearwardly toward a termination point on the counterweight assembly 26. This termination point includes an end-of-stroke cushion device 42 such as a shock absorber or compression spring. As shown in FIG. 7, the end-of-stroke cushion 42 may comprise a tubular member 44 mounted on a flange 46 of the counterweight assembly 26. Within the tubular member 44 is a compression spring 48 and a stop flange 50 firmly attached to the end of the cable segment 38". This impact-absorbing means, which acts as an end-of-stroke cushion, may be modified in any number of known ways without departing from the intended function described herein. The preferred embodiment shown in FIG. 7 allows the tubular member 44 to be curved to avoid conflict with other moving parts that will be described later.

The forward movement of the counterweight assembly 26 is partially resisted by a pair of coil tension springs 52, which are attached at one end to the counterweight assembly 26 and at opposite ends to a mounting structure 54 at the rearward end of the frame 12. The attachment to the counterweight assembly can be accomplished in a variety of ways, two of which will be described separately below. An impact cushioning spring 56 is situated at the forward end of the frame 12 at a position between the barrel guide sleeve 24 and the forward end of travel of the counterweight assembly 26.

As a further aspect of the present invention, the counterweight assembly 26 includes a pair of linearly-reciprocating throwweights 58 which are thrust forwardly and at a downward angle at a predetermined point along the travel of the counterweight assembly 26 so as to further enhance the recoil counter-vectoring effects of the present invention. In preferred form, these throwweights 58 are automatically triggered and/or re-cocked by movement of the counterweight assembly 26. The throwweights 58 may be made of any dense, heavy material such as steel, lead or, in preferred form, depleted uranium.

A preferred way of mounting the throwweights 58 is to use an angled guide cable 60 which extends through an internal bore 62 of each throwweight 58. This is best illustrated in FIG. 7. One end 62 of each guide cable 60 is attached to a rear mounting flange 54 on the counterweight assembly 26. The opposite end 64 of the guide cable 60 is adjustably mounted to a forward position on the counterweight assembly 26, as described below.

Figure 8:
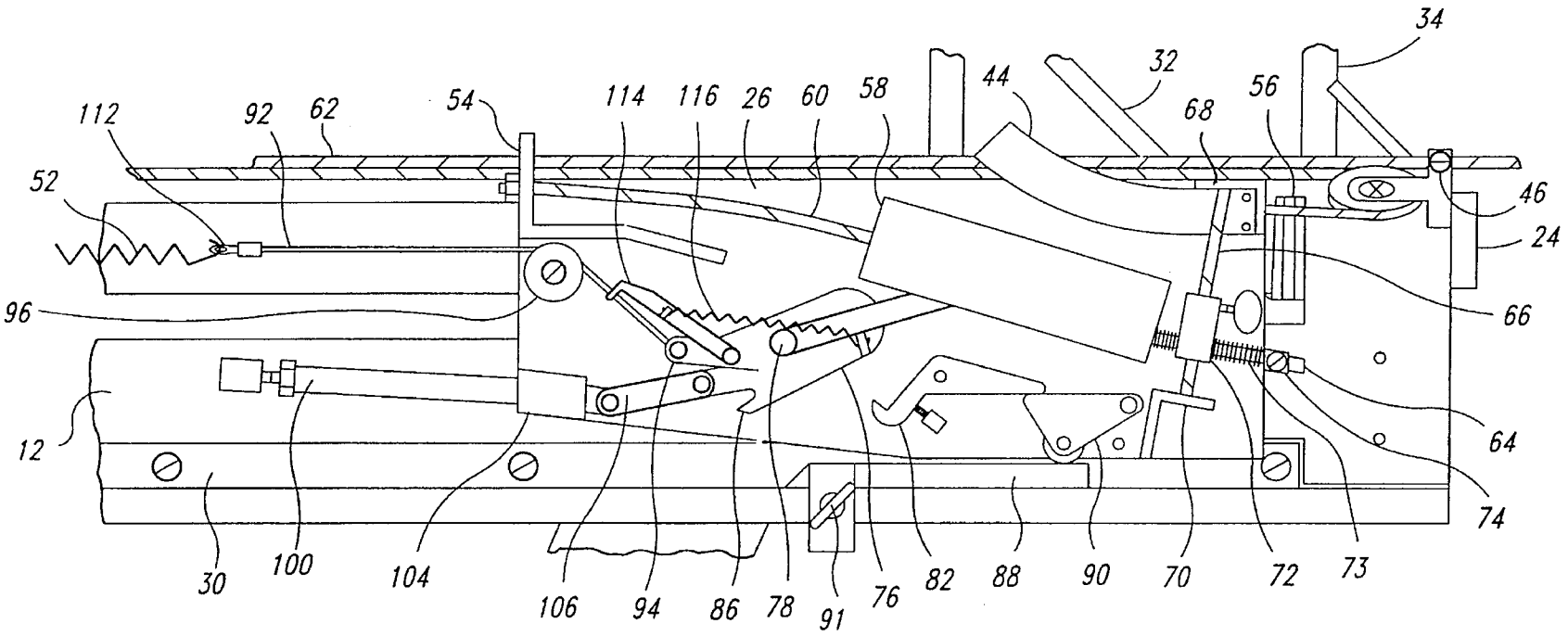
FIG. 8 is an enlarged fragmentary view of an alternate embodiment of a throwweight mechanism on the counterweight assembly on the right side of the gun.

Referring specifically to FIGS. 5, 7 and 8, the adjustable forward mounting of the guide cable 60 is achieved in preferred form by extending a mounting cable 66 between upper and lower flanges 68, 70 on the counterweight assembly 26. An attachment collar 72 is provided on each mounting cable 66 to adjustably guide the forward end 64 of the guide cable 60. An end-of-movement cushion spring 73 is provided on each cable 60 and may be held in place by the use of ordinary set screws, or the like. The flexibility of the guide cable 60 allows the throwweight 58 to travel a slightly irregular path as necessary to be moved from a set position, as shown in FIGS. 2 and 3, to a forward, downward position, as shown in FIGS. 7 and 8. The flexible nature of the mounting cable 66 allows the second end 64 of the mounting cable to be positioned along a variably arcuate path relative to the opposite end 62 of the guide cable 60. Angular adjustability is provided by movement of the adjustment member 72 while tension of the cushion spring 73 may be adjusted by movement of a set screw collar 74.

Movement of each throw weight 58 is controlled by a swing arm 76 which is pivotally mounted 78 on the counterweight assembly 26. A portion of the swing arm 76 extends through a medial slot 80 in the throwweight 58, as best illustrated in FIG. 7. For clarity in understanding the release and movement of the swing arms 76 and throwweights 58, comparison should be made between FIGS. 2 and 7 and FIGS. 3 and 8, respectively, for comparison between cocked and fired positions. Each swing arm 76 is held in a cocked position by engagement of a pivotal sear 82 with a catch 84, 86 on each swing arm 76. Upon firing, recoil of the gun barrel assembly causes the counterweight assembly 26 to slide forwardly on the frame 12. As it approaches its forward end of stroke, an adjustable trip 88 comes in contact with a roller lever 90, displacing the roller lever 90 and causing the pivotal sear 82 to be tripped. Adjustment of the trip 88 may be accomplished by slidable attachment with an ordinary thumb screw 91 along the length of the frame 12 at the position predetermined to cause the pivotal sear 82 to be tripped at an appropriate time to allow the throwweights 58 to be thrust forwardly and downwardly by the swing arm 76.

The swing arm 76 is rotationally propelled by tension added to the return springs 52 upon firing of the gun 10 in forward movement of the counterweight assembly 26. Two comparable alternate embodiments are shown in FIGS. 7 and 8.

Referring first to FIG. 7, therein a cable 92 is attached at one end 94 to a lever of the swing arm 76. The cable 92 passes over a pulley 96 on the counterweight assembly 26 and extends to a second end 98 which is adjustably attached to a midportion of one return spring 52. The second end attachment 98 may be positioned so that there is little or no tension on the cable 92 when the swing arm 76 and counterweight assembly 26 are in the cocked position (FIG. 2). Tension on the return spring 52 increases as the counterweight assembly 26 is slid forward. Upon the roller lever 90 contacting the adjustable trip 88, the rotating sear 82 releases the catch 84 of the swing arm 76. Upon release, the return spring 52 pulls the cable 92, rotating the swing arm 76 and, thereby, thrusting the throwweight 58 forwardly and downwardly along the guide cable 60.

After complete forward travel of the counterweight assembly 26, the return springs 52 pull the counterweight assembly 26 rearwardly toward its set position. The swing arms 76 are reset or cocked upon return by contact between a plunger 100 and plunger stop 102 mounted on the frame 12. This plunger is guided for reciprocating movement by a guide bearing 104 on the counterweight assembly 26. One end of the plunger 100 is connected by a pivotal link 106 to a lever on the swing arm 76. The opposite end of the plunger 100 includes an abutment 108 which is adjusted by a set screw 110 to control the length of the plunger 100 and, thereby, the cocked position of the swing arm 76.

The alternate embodiment illustrated in FIGS. 3 and 8 differ only in the connection of the swing arm 76 to the return spring 52. In this embodiment, the connector cable 92 is attached 112 at its second end to an end of the return spring 52. A tension arm 114 is pivotally mounted to the swing arm 76 and spring biased 116 to assist in returning the swing arm 76 and throwweight 58 to a cocked position.

In preferred form, the position of the tension arm 114 is adjusted by the spring 116 such that it is directly aligned with the rotational center 78 of the swing arm 76 and the center of the cable 42 as it passes over the pulley 96. By aligning the tension arm 114 at dead center or even slightly over center, it does not interfere with or hinder forward motion of the swing arm 76 and throwweight 58. It does, however, provide a substantial assistance in recocking the throwweight 58 without relying solely on tension of the return spring 52.

Another novel aspect of the present invention relates to the firing mechanism. Referring to FIGS. 2, 6 and 9–12, therein can be seen a self-cocking firing pin 118 which works in concert with the bolt 20 and trigger mechanism.

Referring to FIG. 2, the trigger mechanism includes a rotatable trigger 120 biased by a spring 122. The trigger 120 is connected by a transfer bar 124 to a transfer lever 126. Movement of the trigger 20, and thereby the transfer bar 124 and transfer lever 126, causes displacement of a firing pin sear 128.

Figure 11:
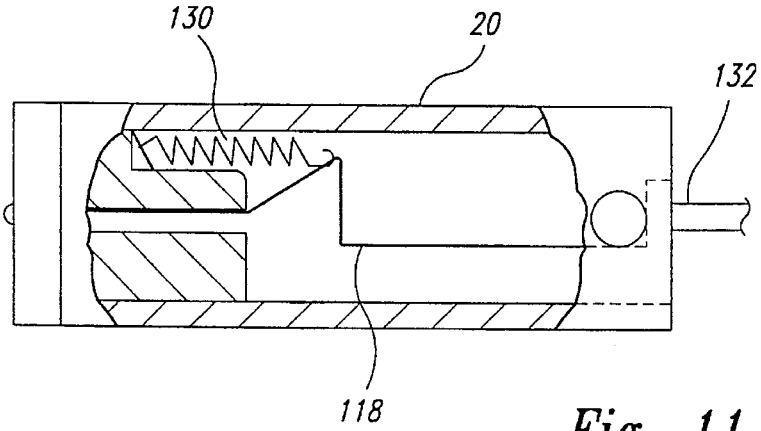
FIG. 11 is a partially cut-away left side view of the bolt.

Referring to FIG. 11, within the bolt 20, the firing pin 118 is forwardly biased by a firing pin spring 130. Referring now also to FIG. 9, it can be seen that a firing pin cable 132 extends rearwardly from the firing pin 118. The cable 132 extends rearwardly through an end member 134 of the receiver 16 and is then curved through a radial groove 136 in the receiver end 134. The cable 132 is reversed in direction and terminates at a cable hook 138. This can be best understood by viewing FIGS. 6 and 9. When the bolt 20 is manually opened by moving the bolt handle 140 in the guide slot 142, the loading port 144 is opened allowing a spent round to be removed or new round to be chambered. When the bolt 20 is shifted rearwardly, slack in the firing pin cable 132 is taken up by a tension spring 146 which is housed within a guide tube 148. This causes the cable hook 138 to be engaged by the sear 128 upon opening of the bolt 20. The firing pin 118 is now cocked, but the firing pin spring 130 is not put into tension until the bolt 20 is manually slid forward to close the loading port 144 and chamber 18. In this manner, the firing pin 118 is automatically cocked upon manually working the bolt 20 or rechambering a round. This structure could be modified to be gas operated rather than manually operated, if desired. Also, the action could be modified to be auto-loading, gas operated or otherwise, if desired.

It can be seen from the above description that the present invention provides a gun that effectively redirects or counter-vectors its firing recoil. As the gun barrel assembly recoils rearwardly, the counterweight assembly 26 is shifted forwardly twice the distance of the barrel's recoil. Also, the forward and downward shifting of the throwweights 58 serve to further counteract recoil and muzzle lift.

The embodiment shown will operate effectively in any position from vertical to approximately 30° below horizontal. Use of this type of gun at a sharper decline would require adjustment to the balance between the weight of the counterweight assembly and tension of the return springs 52 or other compensating means to prevent premature shifting.

Of course, many variations can be made to the preferred embodiment which is described and shown herein without departing from the spirit and scope of the present invention. For this reason, the described embodiments are not to be limiting to the scope of patent protection. Instead, my patent protection is to be determined by the following claim or claims interpreted according to accepted doctrines of claim interpretation, including the doctrine of equivalents and reversal of parts.

What is claimed is:

1. A recoil counter-vectoring gun, comprising:

a frame;

a gun barrel assembly including a barrel and a receiver having a bolt therein;

said gun barrel assembly being slidably mounted to longitudinally reciprocate on said frame between a forward position and a rearward position;

means for firing said gun when said gun barrel assembly is substantially at its forwardmost position; and an adjustable recoil counter-vectoring mechanism, including:

a counterweight assembly slidably mounted to longitudinally reciprocate on said frame between a forward position and a rearward position independent of the gun barrel assembly;

a fixed pulley mounted on said frame;

a traveling pulley mounted on said gun barrel assembly;

a cable means having a first end fixed relative to said frame, passing over said traveling pulley and then said fixed pulley toward a second end attached to said counterweight assembly, wherein firing of said gun causes said gun barrel assembly to recoil rearwardly such that rearward movement of said traveling pulley causes the cable means to pull the counterweight assembly forward on said frame a distance substantially equal to twice the recoil distance of the gun barrel assembly.

2. The gun according to claim 1, further comprising at least one throwweight slidably mounted on the counterweight assembly for movement between a forward and rearward position and means for shifting the throwweight forwardly on the counterweight assembly at a predetermined position relative to full forward movement of the counterweight assembly.

3. The gun according to claim 2, wherein slidable movement of the throwweight is at a downward angle relative to sliding movement of the counterweight assembly as the throwweight is shifted forwardly.

4. The gun according to claim 3, wherein the downward angle of the throwweight movement is adjustable.

5. The gun according to claim 2, wherein movement of the throwweight is guided along a cable having opposite ends supported by the counterweight assembly.

6. The gun according to claim 5, wherein slidable movement of the throwweight is at a downward angle relative to sliding movement of the counterweight assembly as the throwweight is shifted forwardly.

7. The gun according to claim 6, wherein the downward angle of the throwweight movement is adjustable.

8. The gun according to claim 5, wherein means for shifting the throwweight includes a pivotally-mounted swing arm which is cocked in a first position by movement of the counterweight assembly to its substantially rearwardmost position and then released for forwardly moving the throwweight upon the counterweight assembly reaching a predetermined sliding position relative to a substantially forwardmost position.

9. The gun according to claim 8, wherein the position of release for the swing arm may be adjustably set along the length of the forward and rearward slidable movement of the counterweight assembly.

10. The gun according to claim 8, further comprising a spring means for forwardly swinging the swing arm.

11. The gun according to claim 10, wherein the spring means also operates to return the counterweight assembly to its rearward position after firing of the gun and forward cycling of the counterweight assembly.

12. The gun according to claim 10, wherein the swing arm is reset, causing rearward movement of the throwweight, upon return of the counterweight assembly to its substantially rearwardmost position.

13. The gun according to claim 1, wherein said firing means includes a spring-actuated firing pin whereby the firing pin is cocked by a trigger sear upon substantially fully opening the bolt and an actuation spring is then tensioned upon closing movement of the bolt.

14. The gun according to claim 13, further comprising a firing pin cable having a first end fixed to the firing pin and angled around a bend to a second end adapted to engage the firing pin sear.

* * * * *